US007069818B1

(12) United States Patent
Huang

(10) Patent No.: US 7,069,818 B1
(45) Date of Patent: Jul. 4, 2006

(54) RATCHET WRENCH

(76) Inventor: Ping Wen Huang, No. 5, Alley 24, Lane 247, Sinyi St., Wurih Township, Taichung County 414 (TW)

( * ) Notice: Subject to any disclaimer, the term of this patent is extended or adjusted under 35 U.S.C. 154(b) by 0 days.

(21) Appl. No.: 11/294,517

(22) Filed: Dec. 6, 2005

(51) Int. Cl.
*B25B 17/00* (2006.01)

(52) U.S. Cl. ..... 81/57.29; 81/58.1; 81/63.1

(58) Field of Classification Search ..... 81/58.1, 81/63.1, 180.1, 57.29, 57.13, 436, 437
See application file for complete search history.

(56) References Cited

U.S. PATENT DOCUMENTS 4,128,025 A * 12/1978 Main et al. ..... 81/58.1
4,406,184 A * 9/1983 Cockman, Jr. ..... 81/57.29
6,457,386 B1 * 10/2002 Chiang ..... 81/62

* cited by examiner

*Primary Examiner*—Jacob K. Ackun, Jr.
(74) *Attorney, Agent, or Firm*—Rosenberg, Klein & Lee

(57) ABSTRACT

A ratchet wrench including a hollow handle, a handle sleeve fitted on the handle, a transmission rod fitted in the handle, a driving head mounted in one end of the handle and a transmission mechanism. The transmission mechanism is arranged in the handle sleeve and coupled with the handle sleeve. The transmission mechanism is also drivingly connected with the transmission rod. When rotating the handle sleeve relative to the handle, the transmission rod is driven via the transmission mechanism. The transmission rod further drives the driving head to output torque for wrenching a work piece.

2 Claims, 4 Drawing Sheets

RATCHET WRENCH

BACKGROUND OF THE INVENTION

The present invention is related to a ratchet wrench including a handle and a handle sleeve fitted around the handle. When rotating the handle sleeve relative to the handle, a driving head is driven through a transmission mechanism to output torque.

FIG. 4 shows a conventional ratchet wrench 7 having a handle 71 and a head section 72 integrally connected with the handle 71. A working head 721 is mounted in the head section 72. An adjustment button 8 is disposed on the head section 72 for switching the wrenching direction of the working head 721.

In use, the adjustment button 8 is first rotated to decide whether the working head 721 wrenches a work piece clockwise or counterclockwise. The handle 71 is reciprocally swung to drive the working head 721 for wrenching a work piece. However, it is hard for a user to microadjust the work piece by means of swinging the handle 71. Moreover, in the case of a narrow working space, it will be hard for the user to reciprocally swing the handle 71 for wrenching the work piece.

In addition, the conventional ratchet wrench can be only manually operated. This leads to low working efficiency.

SUMMARY OF THE INVENTION

It is therefore a primary object of the present invention to provide a ratchet wrench which can be operated in a narrow working space. In addition, with the ratchet wrench, a can microadjust a work piece. Also, the ratchet wrench can be driven by a power tool to save operating time.

According to the above object, the ratchet wrench of the present invention includes:

a hollow handle having a first end section and a second end section distal from each other, the handle being formed with a receiving tunnel between the first and second end sections, the first end section being formed with a radial through hole communicating with the receiving tunnel;

a handle sleeve having a first fitting section and a second fitting section, the first fitting section being fitted on the handle near the second end section, the handle sleeve and the handle being rotatable relative to each other, the second fitting section of the handle sleeve rearward extending from the handle;

a transmission rod fitted through the receiving tunnel of the handle, the transmission rod including a first head section and a second head section, a circumference of the first head section being formed with ratchets, an annular groove being formed on the transmission rod adjacent to the first head section, a restricting pin being fitted through the handle near the through hole, the restricting pin extending from outer face of the handle into the receiving tunnel, the restricting pin being inlaid in the annular groove of the transmission rod to prevent the transmission rod from being axially extracted out of the handle;

a driving head mounted in the through hole of the handle, the driving head including a working section and a ratcheted disc opposite to the working section, the ratchets of the first head section of the transmission rod being engaged with the ratchets of the ratcheted disc of the driving head;

a transmission mechanism disposed at the second end section of the handle for driving the transmission rod; and an adjustment button fitted on the transmission mechanism for switching the wrenching direction of the driving head.

The present invention can be best understood through the following description and accompanying drawings wherein:

DETAILED DESCRIPTION OF THE PREFERRED EMBODIMENTS

Figure 1:
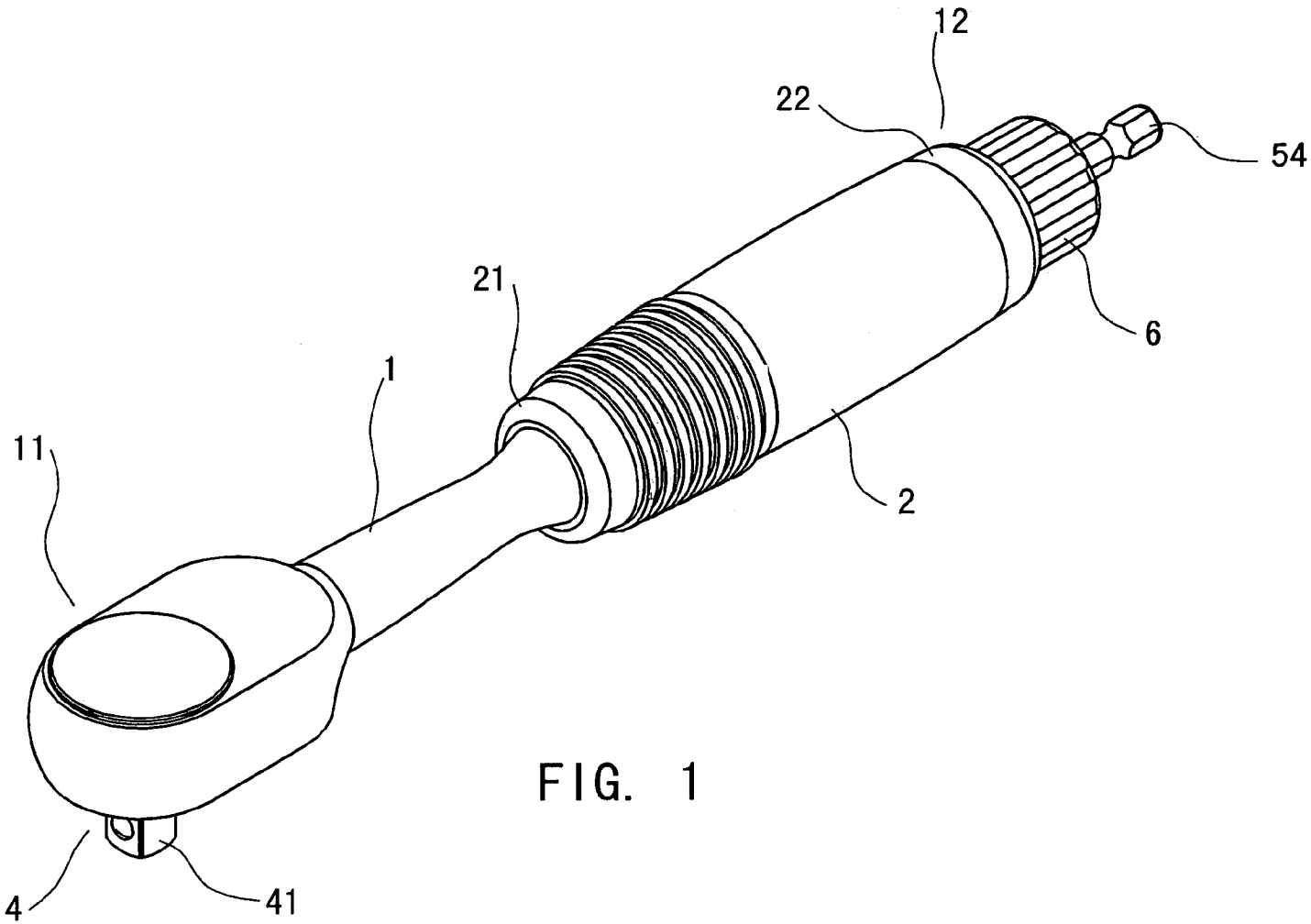
FIG. 1 is a perspective assembled view of the present invention.
Figure 2:
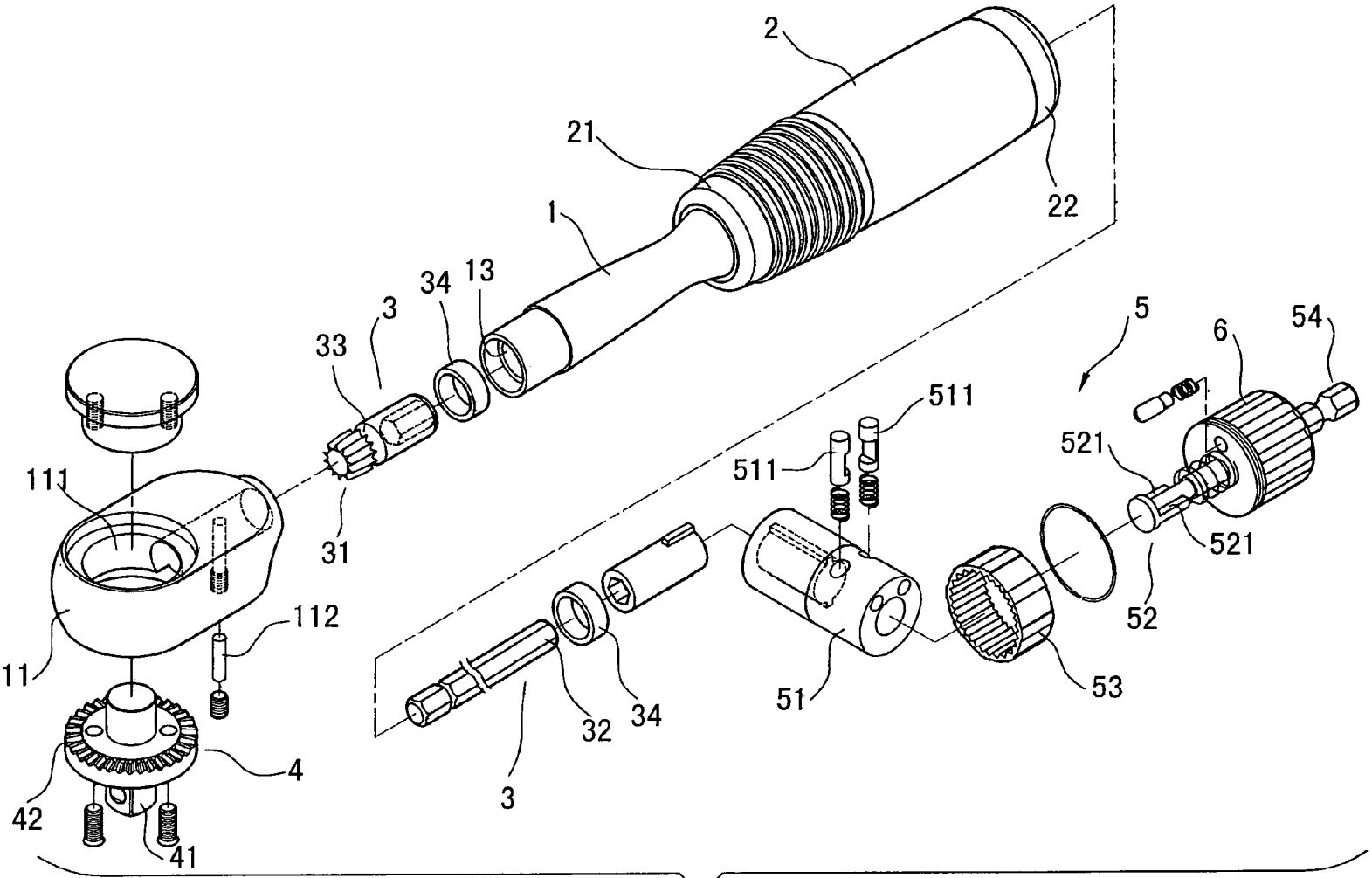
FIG. 2 is a perspective exploded view of the present invention.
Figure 3:
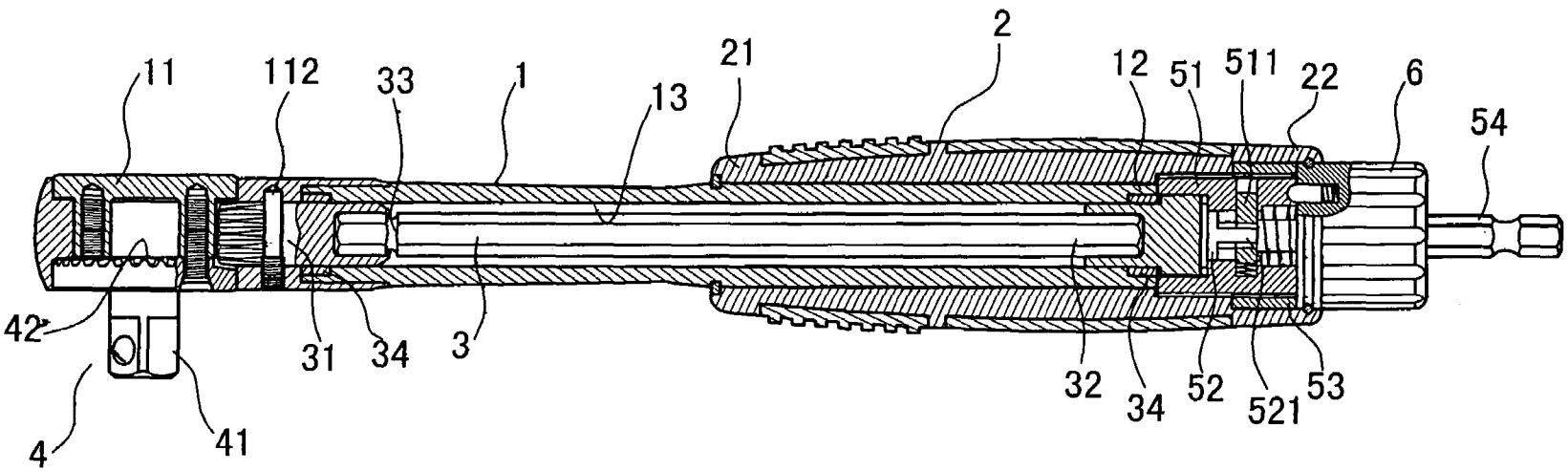
FIG. 3 is a sectional view of the present invention.
Figure 4:
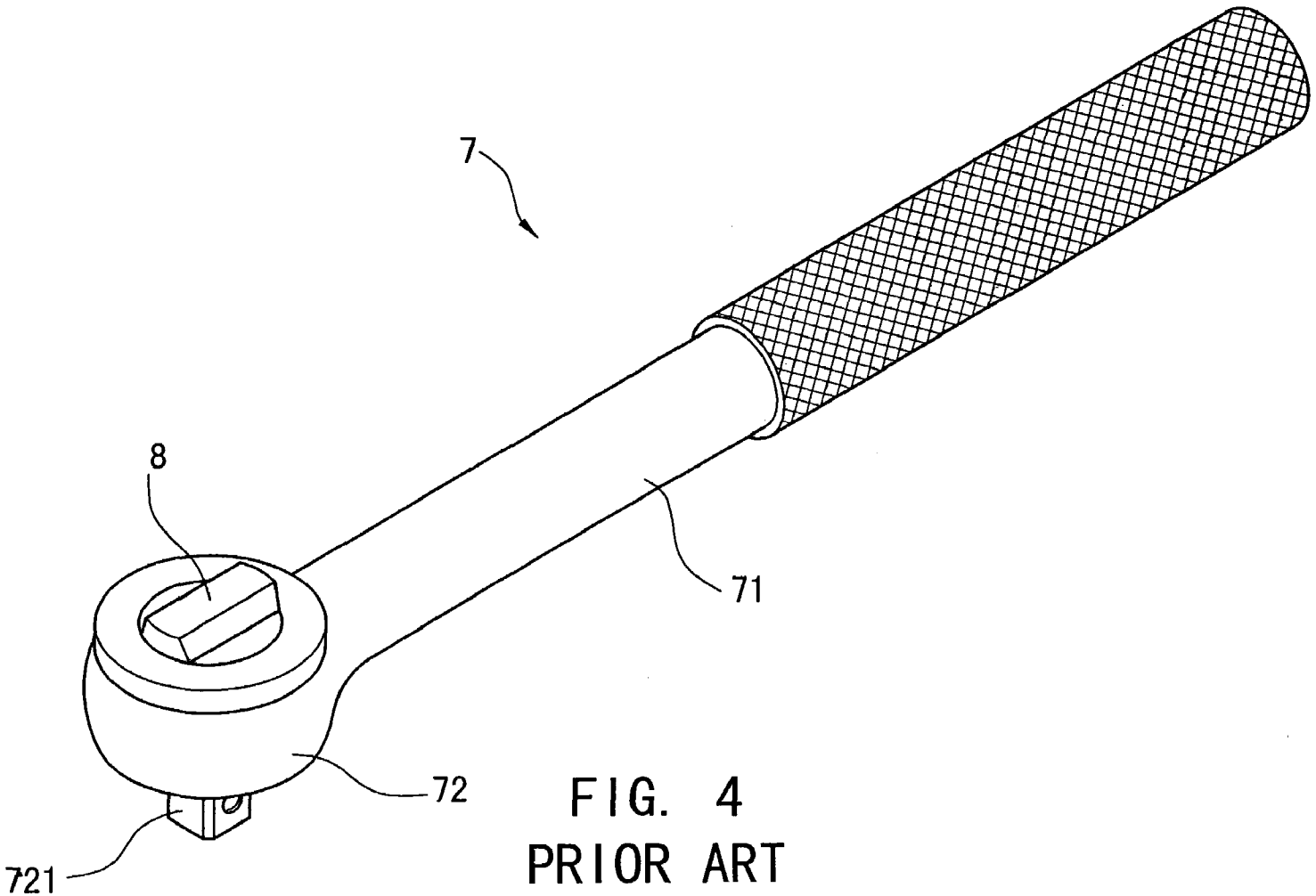
FIG. 4 PRIOR ART
FIG. 4 is a perspective assembled view of a conventional ratchet wrench.

Please refer to FIGS. 1 to 3. The ratchet wrench of the present invention includes a hollow handle 1 having a first end section 11 and a second end section 12 distal from each other. The handle 1 is formed with a receiving tunnel 13 between the first and second end sections 11, 12. The first end section 11 is formed with a radial through hole 111 communicating with the receiving tunnel 13.

The ratchet wrench of the present invention further includes a handle sleeve 2 having a first fitting section 21 and a second fitting section 22. The first fitting section 21 is fitted on the handle 1 near the second end section 12. The handle sleeve 2 and the handle are rotatable relative to each other. The second fitting section 22 of the handle sleeve 2 rearward extends from the handle 1.

The ratchet wrench of the present invention further includes a transmission rod 3 fitted through the receiving tunnel 13 of the handle 1. The transmission rod 3 includes a first head section 31 and a second head section 32. The circumference of the first head section 31 is formed with ratchets 311. An annular groove 33 is formed on the transmission rod 3 adjacent to the first head section 31. A restricting pin 112 is fitted through the handle 1 near the through hole 111. The restricting pin 112 extends from outer face of the handle 1 into the receiving tunnel 13. The restricting pin 112 is inlaid in the annular groove 33 to prevent the transmission rod 3 from be ing axially extracted out of the handle 1. Two bearings 34 are fitted on the transmission rod 3 respectively near the first and second head sections 31, 32 for reducing frictional force between the transmission rod 3 and the handle 1. Accordingly, the transmission rod 3 can be more smoothly rotated.

The ratchet wrench of the present invention further includes a driving head 4 mounted in the through hole will of the handle 1. The driving head 4 includes a working section 41 and a ratcheted disc 42 opposite to the working section 41. The ratchets 311 of the first head section 31 of the transmission rod 3 are engaged aged with the ratchets of the ratcheted disc 42 of the driving head 4.

The ratchet wrench of the present invention further includes a transmission mechanism 5 disposed at the second end section 12 of the handle 1. The transmission mechanism 5 includes a first transmission member 51, a second transmission member 52 and a ratcheted ring 53. The ratcheted ring 53 is coupled with the second fitting section 22 of the handle sleeve 2 and fitted around the first transmission member 51. The first transmission member 51 is coupled with the second head section 32 of the transmission rod 3.

The first transmission member 51 has two controlling pawls 511 side by side arranged on the first transmission member 51. The second transmission member 52 has two push sections 521 for pushing the two controlling pawls 511. The second transmission member 52 also has a connecting section 54 protruding from the handle 1.

The ratchet wrench of the present invention further includes an adjustment button 6 fitted on the connecting section 54 of the second transmission member 52.

In operation, a user can hold the handle sleeve 2 to directly reciprocally swing the handle 1 for wrenching a work piece (not shown).

Alternatively, in the case of a narrow working space, the user can rotate the handle sleeve 2 relative to the handle 1. At this time, the handle sleeve 2 can drive the ratcheted ring 53 to rotate. Simultaneously, the ratcheted ring 53 drives the transmission rod 3 to rotate. The transmission rod 3 further drives the driving head 4 to output torque. Accordingly, in the narrow working space, the user can still wrench the work piece. Also, the user can microadjust the work piece. The adjustment button 6 enables the user to selectively switch the wrenching direction of the driving head 4.

In addition, as necessary, the connecting section 54 of the second transmission member 52 can be coupled with a pneumatic tool or power tool. The second transmission member 2 can be driven by the power tool further drive the first transmission member 51 for outputting torque. This can save operating time.

The above embodiments are only used to illustrate the present invention, not intended to limit the scope thereof. Many modifications of the above embodiments can be made without departing from the spirit of the present invention.

What is claimed is:

1. A ratchet wrench comprising:

a hollow handle having a first end section and a second end section distal from each other, the handle being formed with a receiving tunnel between the first and second end sections, the first end section being formed with a radial through hole communicating with the receiving tunnel;

a handle sleeve having a first fitting section and a second fitting section, the first fitting section being fitted on the handle near the second end section, the handle sleeve and the handle being rotatable relative to each other, the second fitting section of the handle sleeve rearward extending from the handle;

a transmission rod fitted through the receiving tunnel of the handle, the transmission rod including a first head section and a second head section, a circumference of the first head section being formed with ratchets, an annular groove being formed on the transmission rod adjacent to the first head section, a restricting pin being fitted through the handle near the through hole, the restricting pin extending from outer face of the handle into the receiving tunnel, the restricting pin being inlaid in the annular groove of the transmission rod to prevent the transmission rod from being axially extracted out of the handle;

a driving head mounted in the through hole of the handle, the driving head including a working section and a ratcheted disc opposite to the working section, the ratchets of the first head section of the transmission rod being engaged with the ratchets of the ratcheted disc of the driving head;

a transmission mechanism disposed at the second end section of the handle for driving the transmission rod; and an adjustment button fitted on the transmission mechanism for switching the wrenching direction of the driving head.

2. The ratchet wrench as claimed in claim 1, wherein the transmission mechanism includes a first transmission member, a second transmission member and a ratcheted ring, the ratcheted ring being coupled with the second fitting section of the handle sleeve and fitted around the first transmission member, the first transmission member being coupled with the second head section of the transmission rod, the first transmission member having two controlling pawls side by side arranged on the first transmission member, the second transmission member having two push sections for pushing the two controlling pawls, the second transmission member further having a connecting section protruding from the handle.

* * * * *